US005913530A

United States Patent [19]

Berger et al.

[11] Patent Number: 5,913,530

[45] Date of Patent: Jun. 22, 1999

[54] SNOWBOARD BINDING

[76] Inventors: Richard W. Berger, 219 Farley Dr., Aptos, Calif. 95003; Brant W. Berger, 1171 San Andreas Rd., LaSelva Beach, Calif. 95076

[21] Appl. No.: 08/876,358

[22] Filed: Jun. 16, 1997

Related U.S. Application Data

[60] Provisional application No. 60/020,404, Jun. 25, 1996.

[51] Int. Cl.[6] ..... A63C 9/081

[52] U.S. Cl. ..... 280/607; 280/618; 280/613; 280/14.2

[58] Field of Search ..... 280/14.2, 613, 280/618, 607

[56] References Cited

U.S. PATENT DOCUMENTS

| | | | |
|---|---|---|---|
| D. 380,289 | 7/1997 | Sand | D2/959 |
| D. 382,320 | 8/1997 | Sand | D21/230 |
| 3,091,043 | 11/1962 | McCorkle | 36/8.3 |
| 3,707,047 | 12/1972 | Nedwick | 36/2.5 |
| 4,371,188 | 2/1983 | Hull | 280/613 |
| 4,463,968 | 8/1984 | Hull | 280/613 |
| 4,964,649 | 10/1990 | Chamberlin | 280/618 |
| 5,021,017 | 6/1991 | Ott | 441/70 |
| 5,028,068 | 7/1991 | Donovan | 280/618 |
| 5,035,443 | 7/1991 | Kincheloe | 280/618 |
| 5,044,654 | 9/1991 | Meyer | 280/613 |
| 5,190,311 | 3/1993 | Carpenter et al. | 280/618 |
| 5,261,689 | 11/1993 | Carpenter et al. | 280/618 |
| 5,277,635 | 1/1994 | Gillis | 441/74 |
| 5,354,088 | 10/1994 | Vetter et al. | 280/618 |
| 5,356,170 | 10/1994 | Carpenter et al. | 280/618 |
| 5,392,537 | 2/1995 | Goldberg | 36/134 |
| 5,520,405 | 5/1996 | Bourke | 280/613 |
| 5,520,406 | 5/1996 | Anderson et al. | 280/624 |
| 5,553,883 | 9/1996 | Erb | 280/607 |
| 5,577,755 | 11/1996 | Metzger et al. | 280/607 |
| 5,586,779 | 12/1996 | Dawes et al. | 280/14.2 |
| 5,722,680 | 3/1998 | Dodge | 280/624 |
| 5,765,853 | 6/1998 | Erb | 280/607 |

FOREIGN PATENT DOCUMENTS

| | | | |
|---|---|---|---|
| 2604913 | 4/1988 | France . | |
| 2501878 | 7/1975 | Germany | 280/613 |
| WO 96/41663 | 12/1996 | WIPO | A63C 9/20 |

OTHER PUBLICATIONS

Forward Motion Design, Patent application and letter, disclosed to Applicants on or about Feb. 20, 1997.

*Primary Examiner*—Richard M. Camby
*Attorney, Agent, or Firm*—Fish & Richardson P.C.

[57] ABSTRACT

A binding includes an upper attachment connected to a boot, a lower attachment connected to a board, a coupler attached to one of the upper and lower attachments, and a coupling mount attached to the other of the upper and lower attachments. The coupling mount and the coupler are configured to automatically engage with each other to lock the upper attachment to the lower attachment when a user wearing the boot steps onto the lower attachment and to permit rotation of the upper attachment relative to the lower attachment when the upper attachment is locked to the lower attachment. A release actuator is actuated to disengage the coupler and the coupling mount. A lock locks the boot in a selected rotary position relative to the board. The coupler includes a collar and a sleeve positioned within the collar. The collar is rotatable relative to the sleeve.

31 Claims, 16 Drawing Sheets

FIG._20
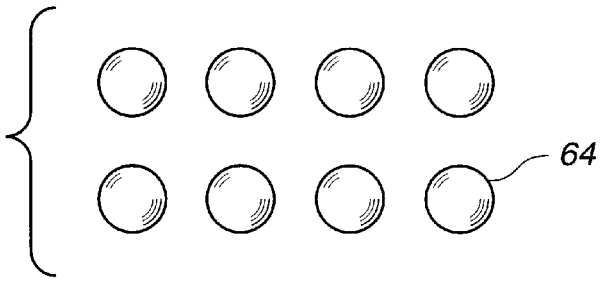
FIG._21
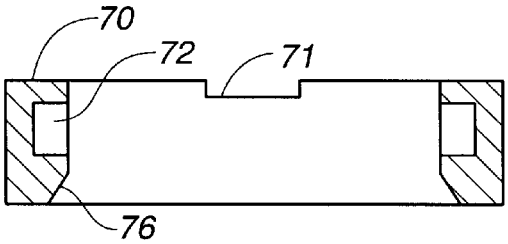
FIG._22
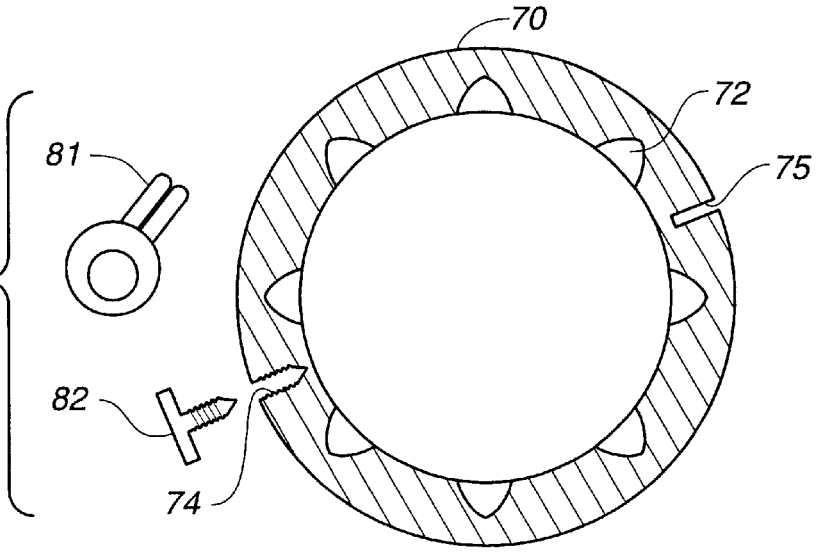
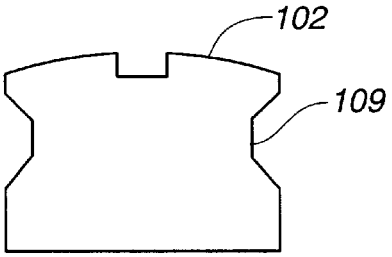
FIG._23
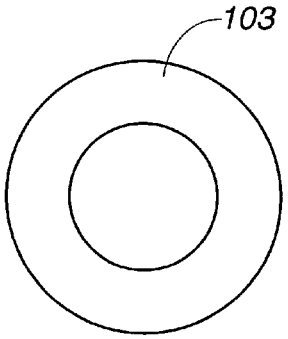
FIG._24

SNOWBOARD BINDING

Subject matter in this application was originally filed in Provisional patent application Ser. No. 60/020,404, filed on Jun. 25, 1996.

The present invention relates to snowboarding and more specifically to a binding mounting a boot to a snowboard so as to permit free rotation of the boot and thus the position of the rider's foot relative to the snowboard while the rider is snowboarding. The binding of the present invention also incorporates features which permit quick coupling and release of the boot to and from the snowboard at a rider selected angular stance position relative to the snowboard.

BACKGROUND OF THE INVENTION

Snowboarding is a sport which combines aspects of surfing, skateboarding, and skiing. The snowboard is longer than a skateboard but shorter than a surfboard and is used as a single ski. Typically, bindings which receive the rider's boots are attached to the snowboard in a fixed position but do not have automatic release capability as do skis. Use of impact release bindings on a snowboard is considered to be undesirable because, unlike in skiing, both feet of the rider are on the same board and the release of only one foot could result in injury to the rider.

Fixed snowboard bindings known heretofore all prevent movement between the snowboard and boots and only permit manual release of the bindings at the location of the attachment of the bindings to the snowboard. This design permitting manual release of the bindings only at the location of the snowboard itself has resulted in injury and even death. For example, three snowboarders are known to have died, at least two by suffocation, because they were unable to reach and release their bindings after becoming buried and covered by snow. The snowboard becomes an anchor, restraining the escape of the rider, when covered by snow due to the inability to easily release from the binding.

The stance position of a rider's feet on the snowboard refers to the angular relationship formed between the midline (lengthwise) of the rider's foot and the midline (lengthwise) of the snowboard itself. The stance position is selected by the rider setting the bindings in a particular fixed relationship to the snowboard during downtime of the snowboard. The particular angle of the selected stance position is referred to in the number of degrees from a reference position in which the bindings are disposed crosswise or sideways to the length or midline of the snowboard. For example, "zero" degrees refers the bindings being set at the reference position, extending straight across the snowboard from edge to edge. Setting the bindings away from the reference position toward the nose of the snowboard is an angle greater than zero degrees while setting the bindings away from the reference position but toward the tail of the snowboard is an angle less than zero degrees which will be identified with a negative (−) sign. Typically, the front foot binding is set at a stance position between 0° to 60° and the back foot binding is set at a stance position between −5° to 55°. Freestylers set their bindings at low angles to position themselves nearly sideways in a skate/surf stance for stability: front foot binding set between 0° to 20°, and back foot binding set between 5° to −15°. Alpine riders set their bindings at the higher angles closer to a skiing position for racing and aggressive carving: front foot binding set between 40° to 60°, and back foot binding set between 35° to 55°. Free riders set their angles somewhere inbetween for a combination of stability and aggressive carving: front foot binding set between 20° to 40°, and back foot binding set between 15° to 35°. Therefore, the selected set stance position is a compromise limiting the forces transmitted to the snowboard from one set position regardless of the terrain and various conditions encountered while riding.

SUMMARY OF THE INVENTION

The solution of the invention to the aforementioned problem is to provide a binding incorporating features which allow the stance position of the rider to change in a natural manner while snowboarding so as to accommodate skating, scooting, chairlift mounting, riding and dismounting, and various terrain encountered on the slope. These features of the binding mount the boot to the snowboard so as to permit the free rotation of the boot and thus the position of the rider's foot relative to the snowboard while the rider is snowboarding. Allowing a rider to transmit forces to the snowboard from any stance position, in a natural manner, improves maneuverability and stability of the rider and snowboard and allows the rider to instantly adjust to the style necessary for each situation encountered while riding.

Another solution of the invention is to provide a binding incorporating features which permit the rider to select the desired angular stance position relative to the snowboard. These features of the binding permit quick coupling and release of the boot to and from the snowboard at the rider-selected angular stance position.

According to one aspect of the invention, a binding includes an upper attachment connected to a boot, a lower attachment connected to a board, a coupler attached to one of the upper and lower attachments, and a coupling mount attached to the other of the upper and lower attachments. The coupling mount and the coupler are configured to automatically engage with each other to lock the upper attachment to the lower attachment when a user wearing the boot steps onto the lower attachment and to permit rotation of the upper attachment relative to the lower attachment when the upper attachment is locked to the lower attachment.

Additional features of the invention may include one or more of the following features.

A release actuator is provided to disengage the coupler and the coupling mount.

A lock is provided for locking the boot in a selected position relative to the board.

The coupler includes a collar and a sleeve positioned within the collar such that the collar is rotatable relative to the sleeve. The release actuator is attached to the collar and is actuated to rotate the collar to disengage the coupler from the coupling mount. A spring biases the collar against rotating. A locking mechanism locks the position of the collar.

The coupler includes ball bearings and the sleeve includes apertures in which the ball bearings are located. The collar has an inner wall defining a plurality of inner surfaces for contacting the ball bearings. The sleeve defines a passage for receiving the coupling mount. The ball bearing location within the sleeve apertures is affected by the presence of the coupling mount within the through hole. The coupler includes a spring and spring plunger located within the sleeve passage.

The coupling mount includes a circumferential channel in which the ball bearings are partly enclosed. The coupling mount is rotatable relative to the sleeve with the ball bearings sliding along the circumferential channel during rotation of the coupling mount.

The lower attachment includes an alignment ring with a slot cut-out. A lock attached to the boot is selectively positionable in the cut-out to lock the boot in a selected rotary position relative to the board. The lock is selectively positionable in the slot for permitting limited rotation of the boot relative to the board.

The alignment ring may include a plurality of cut-outs. The lower attachment further includes a spacer and a mounting plate. The alignment ring is locked in a selected position relative to the mounting plate.

A lower surface of the boot directly contacts a top surface of the board to permit forces to be directly applied from the boot to the top surface of the board.

The coupler is located substantially at a central part of the boot and the coupler mount is located substantially at a longitudinal centerline of the board.

According to another aspect of the invention, a coupling device is provided which includes an upper attachment connectable to a first member, a lower attachment connectable to a second member, a coupler attached to one of said upper and lower attachments, and a coupling mount attached to the other of said upper and lower attachments. The coupling mount and the coupler are configured to engage with each other by a linear motion to lock the upper attachment to the lower attachment and to permit rotation of the upper attachment relative to the lower attachment when the upper attachment is locked to the lower attachment. The coupling movement and coupler are unlocked by a twisting or rotary motion on a locking mechanism on the coupler.

According to another aspect of the invention, a method of adjusting the rotary position of a boot relative to a board is provided which includes the steps of mounting the boot to the board such that the boot is locked to the board and in a first position, unlatching a lock to permit the boot to rotate relative to the board while the boot remains locked to the board, rotating the boot, and latching the lock such that the boot fixed to the board in a second position. The lock may also be left unlatched to allow free rotation of the boot while remaining locked to the board.

According to another aspect of the invention, a method of adjusting the rotary position of a boot relative to a board is provided which includes the steps of mounting the boot to the board by stepping onto the board such that the boot is latched to the board and fixed in a first position, releasing the boot from the board by activating a release actuator, and stepping again onto the board such that the boot is locked to the board and fixed in a second position.

Yet another aspect of the invention is to provide a method of adjusting and locking the rotary position of a boot relative to a board which includes the steps of mounting the boot to the board by stepping onto the board such that the boot is locked to the board but not rotationally fixed and rotating the board relative to the board until a spring-biased latch automatically engages a stop to lock the boot in a fixed position.

Advantages of the invention include quick coupling step-in and release of the boot to the board, the capability of rotating the boot relative to the board with the boot locked to the board, and the capability of rotating the boot to lock in a desired position relative to the board while riding.

BRIEF DESCRIPTION OF THE DRAWINGS

FIG. 20 is a plan view of eight ball bearings of the binding of FIG. 5.

FIG. 21 is a cross-sectional view of the outer bearing collar of the binding of FIG. 5.

FIG. 22 is a top plan view of the outer bearing collar of FIG. 21.

FIG. 23 is a side elevational view of the male coupler of the binding of FIG. 5.

FIG. 24 is a top plan view of the male coupler of FIG. 23.

DESCRIPTION OF THE PREFERRED EMBODIMENTS

Figure 1:
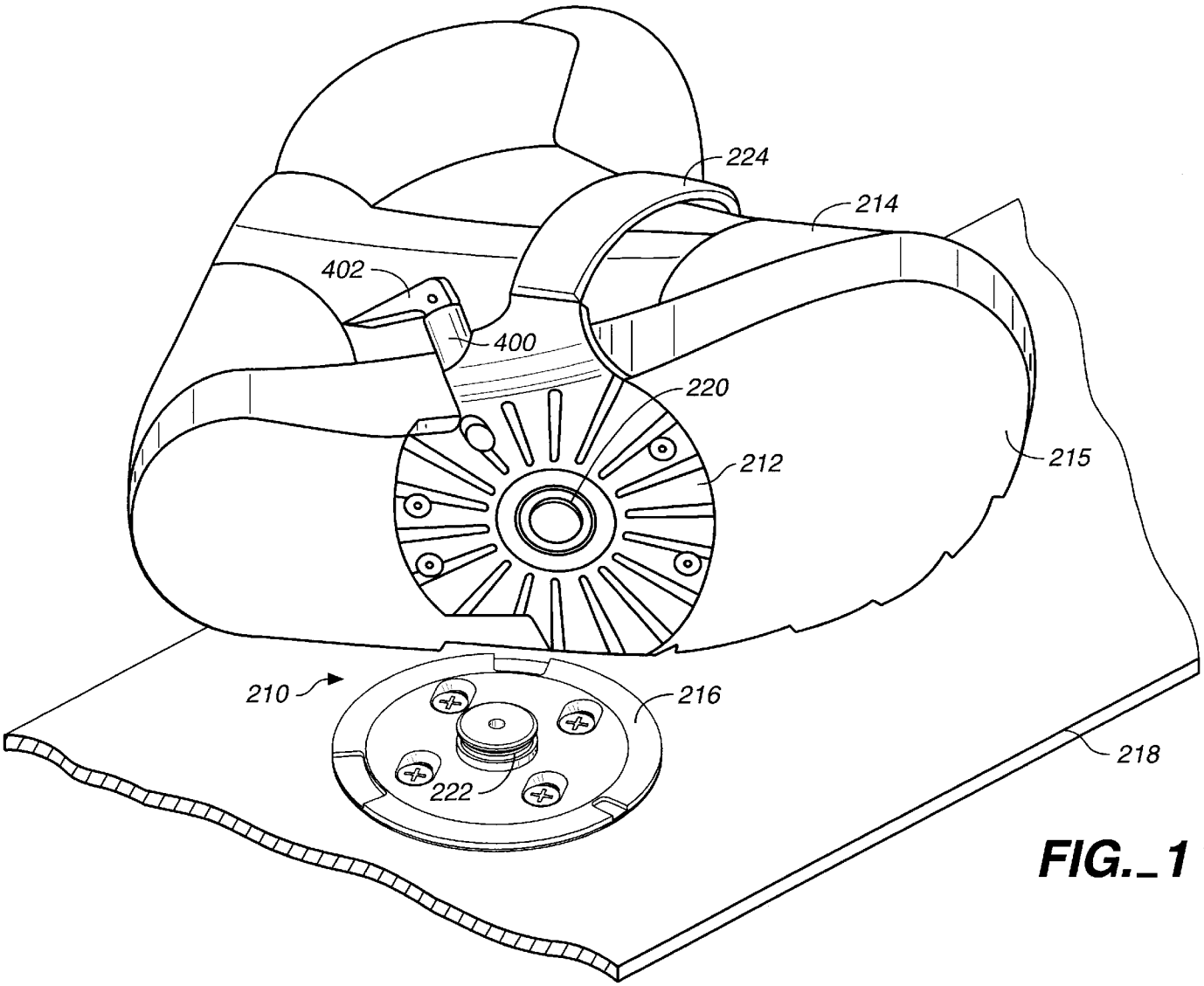
FIG. 1 is a diagrammatic illustration of the binding of the invention shown attached to a boot and a snowboard.

Referring to FIG. 1, a snowboard binding 210 includes an upper attachment plate 212 connected to a snowboot 214, a lower attachment plate 216 connected to a snowboard 218, a coupler 220 attached to upper plate 212, and a coupling mount 222 attached to lower plate 216. Coupling mount 222 and coupler 220 automatically engage with each other to lock upper plate 212 to the lower plate 216 when a user wearing boot 214 steps onto lower plate 216. With upper plate 212 locked to lower plate 216, upper plate 212 is free to rotate relative to lower plate 216. Coupling mount 222 and coupler 220 are disengaged simply by pulling up on a strap 224. This releases upper plate 212 from lower plate 216 permitting the user to step off of board 218.

Figure 2:
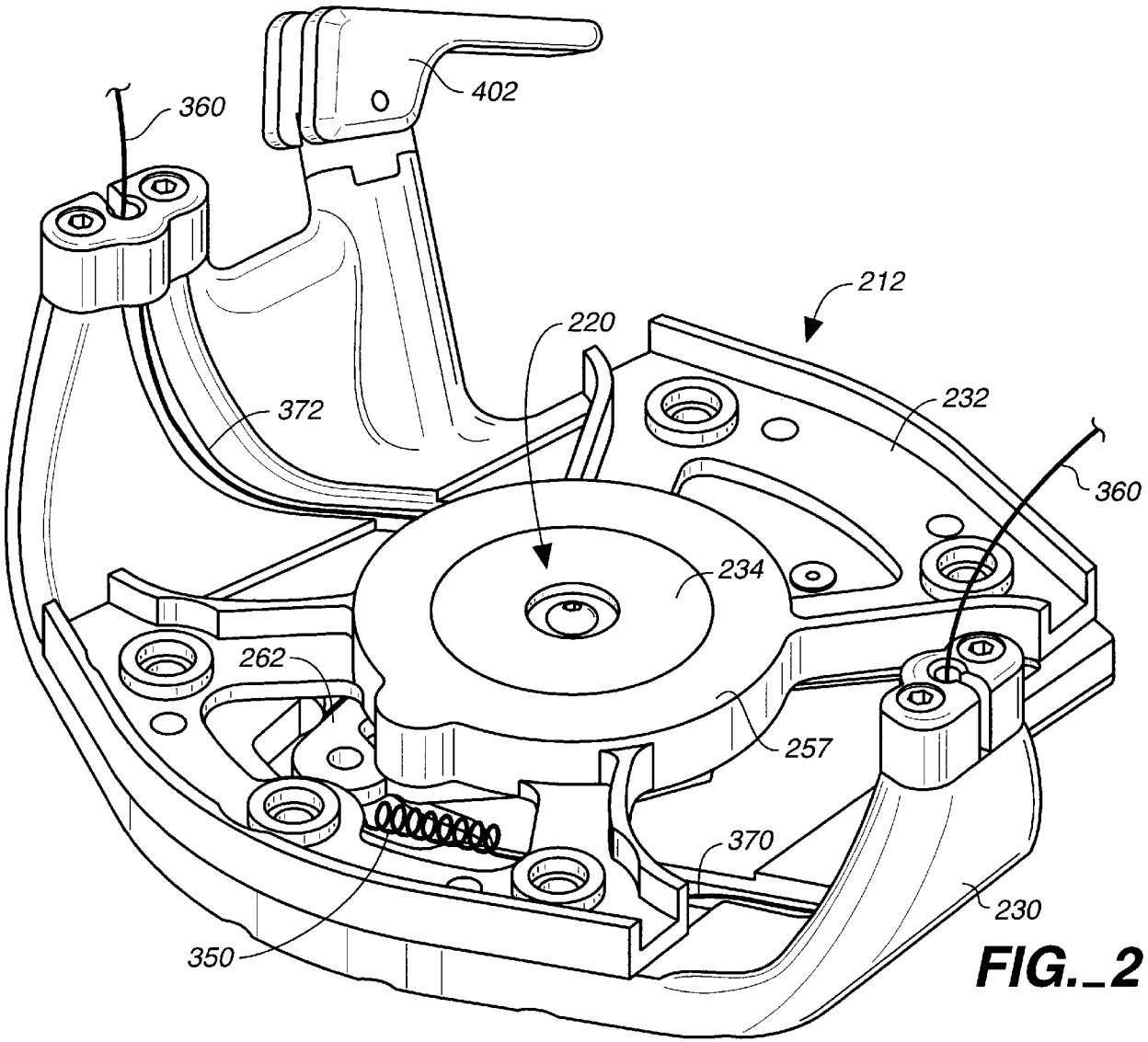
FIG. 2 is a perspective view of an upper attachment plate of the binding of FIG. 1.
Figure 2A:
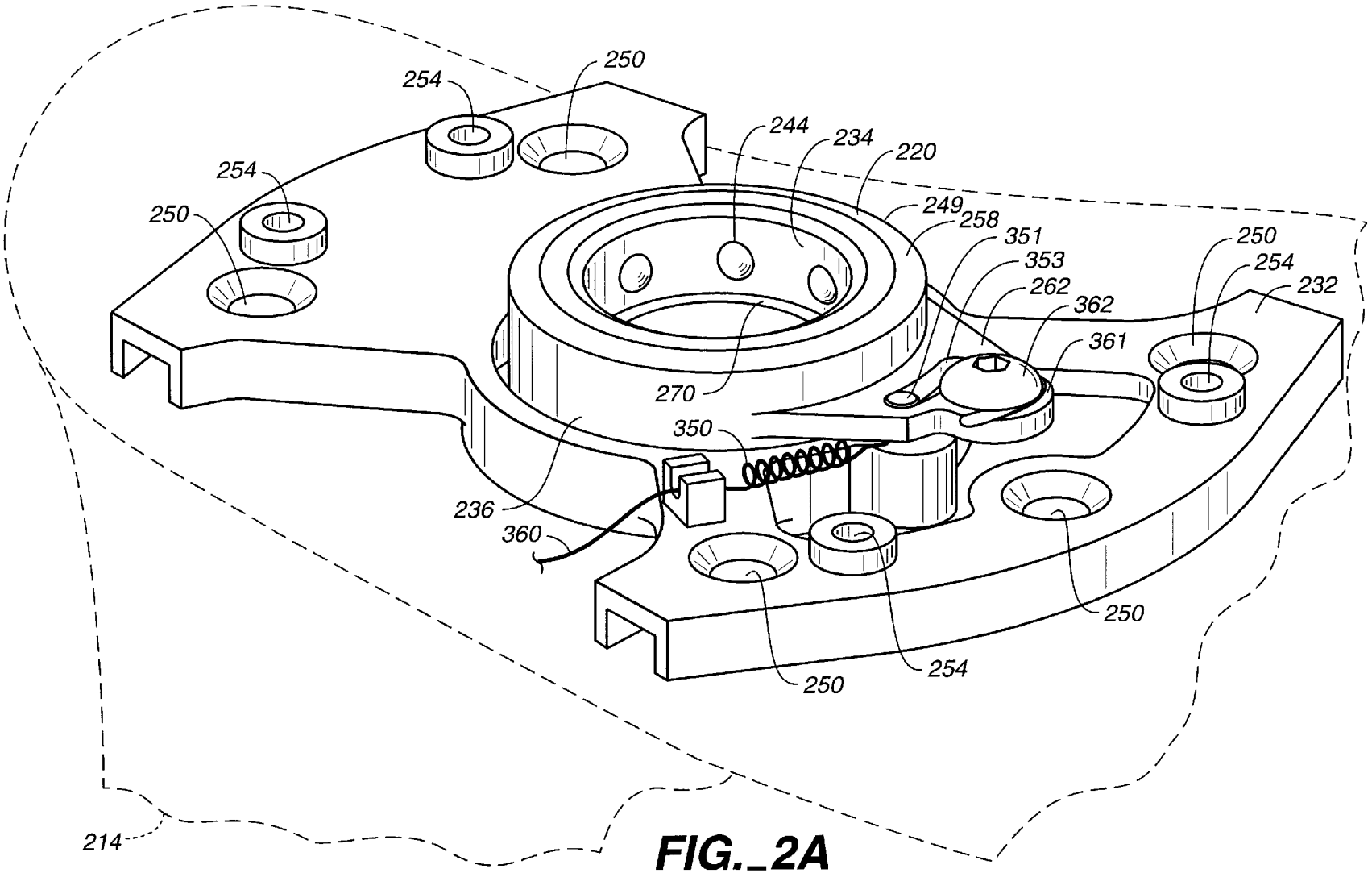
FIG. 2A is a perspective view of an inner mount of the upper attachment plate.
Figure 2D:
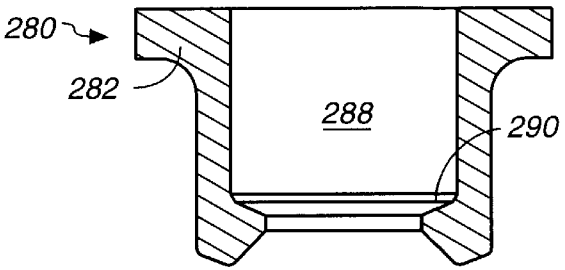
FIG. 2D is a cross-sectional view of an interlock ring of the upper attachment plate.
Figure 2B:
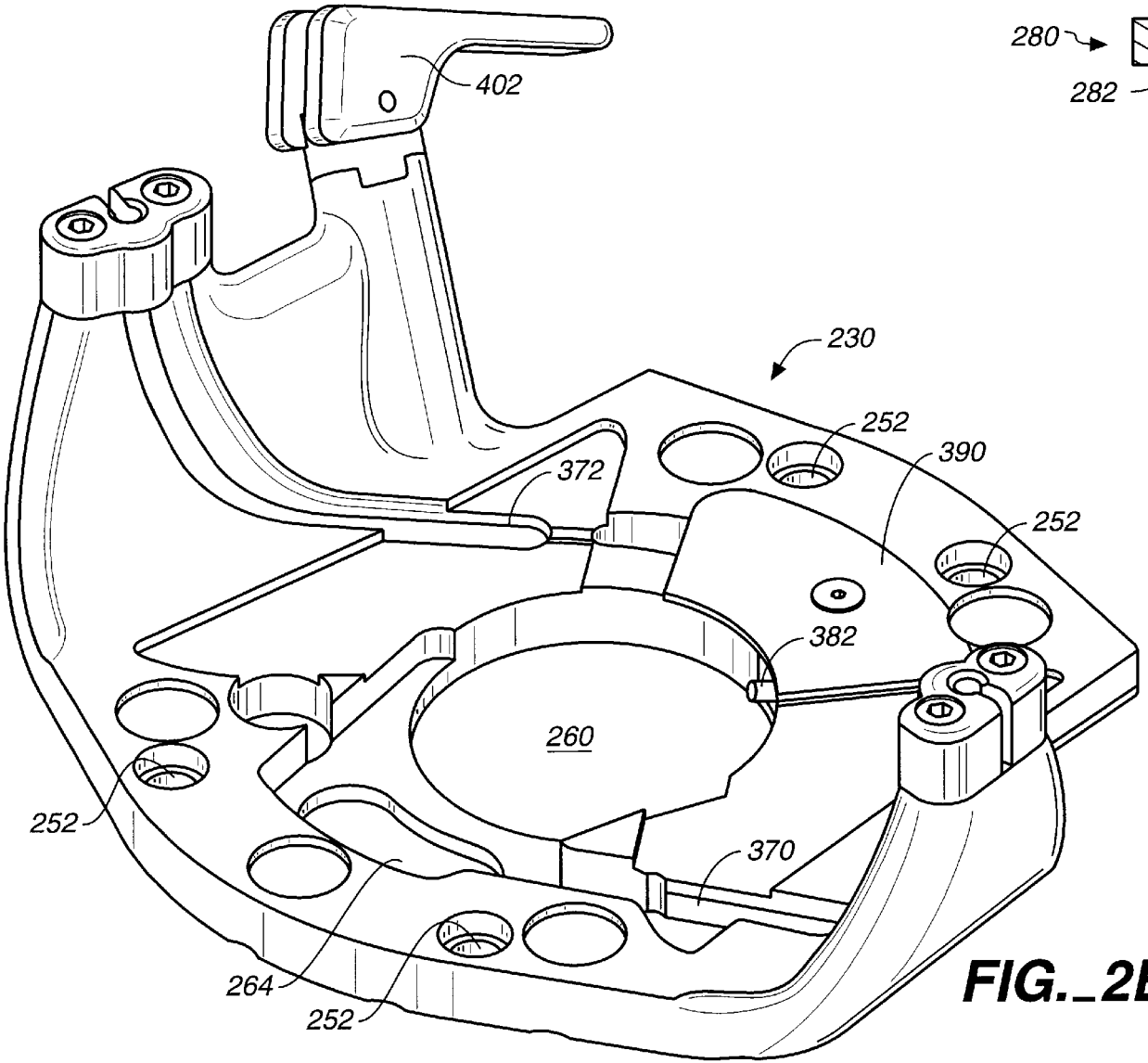
FIG. 2B is a perspective view of an outer housing of the upper attachment plate.

Referring to FIGS. 2-2B, upper plate 212 includes an outer housing 230 and an inner mount 232. As shown in FIG. 2A (in which inner mount 232 is shown upside down relative to its orientation in FIGS. 2 and 2C), inner mount 232 includes a plurality of holes 250 for attaching inner mount 232 to the sole 215 of boot 214 with screws (not shown). Outer housing 230 is attached to inner mount 232 by screws (not shown) accomodated by holes 252 of outer housing 230 and received in threaded holes 254 of inner mount 232.

Figure 2C:
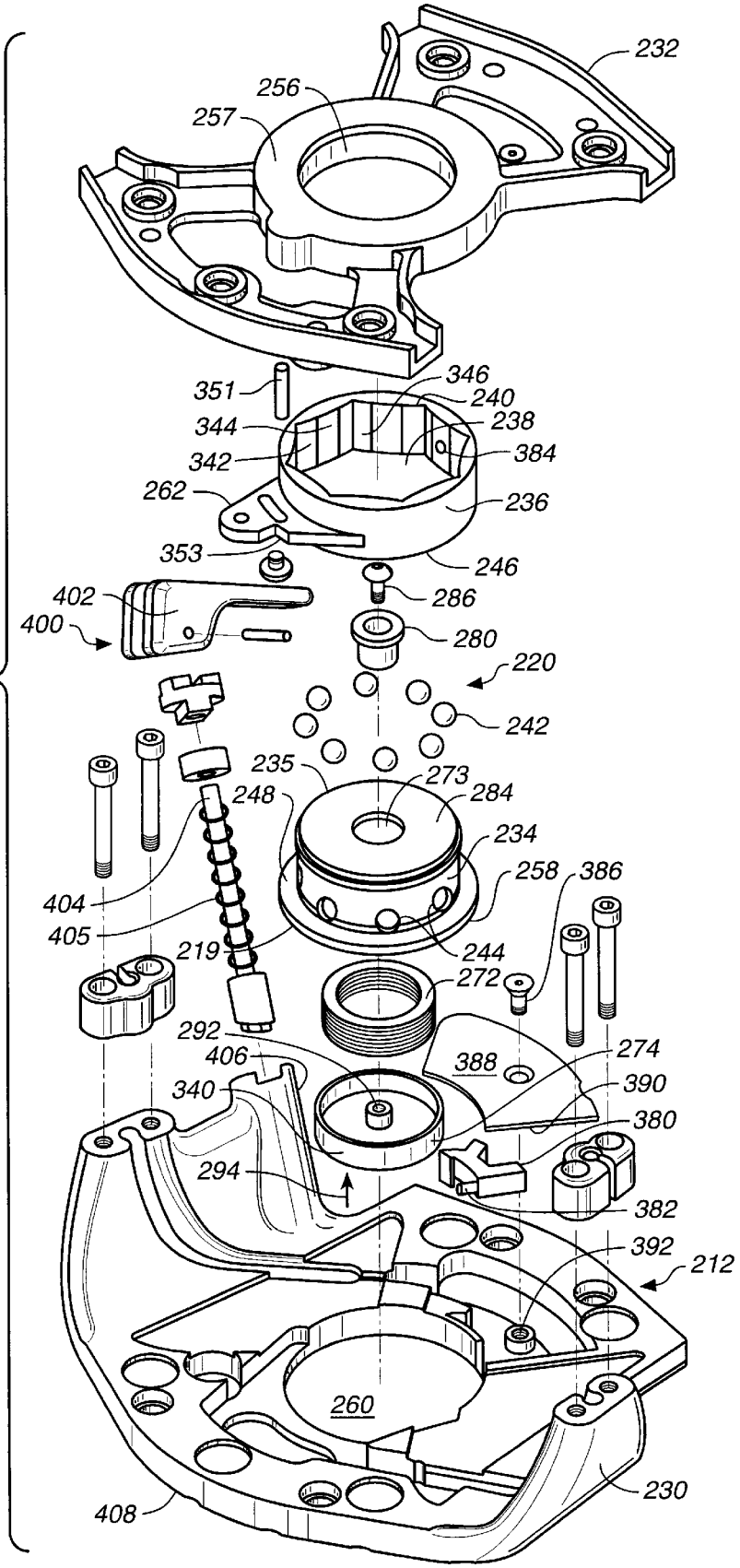
FIG. 2C is an exploded view of the upper attachment plate.

Referring to FIGS. 2A and 2C, coupler 220 includes a female coupler sleeve 234 having an end 235 of reduced diameter which is press fit within an opening 256 defined by a circular section 257 of inner mount 232. Coupler 220 also includes an outer bearing collar 236 having a through bore 238 defined by an inner wall 240. When assembled, coupler sleeve 234 is located within bore 238 of collar 236 (FIG. 2A). Ball bearings 242 are located in apertures 244 which extend through coupler sleeve 234. With collar 236 placed over coupler sleeve 234 such that an end 246 of collar 236 abuts a shelf 248 of sleeve 234 defined by an area of increased diameter 249, ball bearings 242 can contact inner wall 240 of collar 236. It is the interaction between ball bearings 242 and inner wall 240, described further below, which acts to lock upper plate 212 to lower plate 216.

Collar 236 is trapped between inner mount 232 and shelf 248 but remains rotatable relative to coupler sleeve 234. Referring also to FIG. 2A, end 258 of coupler sleeve 234 is received (not a press fit) within an opening 260 of outer housing 230. An actuating handle 262 of collar 236, described further below, is located within a cut-out 264 of outer housing 230. Also attached to outer housing 230 is a locking pawl 380, described further below.

Coupler sleeve 234 defines a passage 270 (FIG. 2A) in which a spring 272 (FIG. 2C) is located, for example, a wave spring formed of spring stainless steel manufactured by Smally of Wheeling, Ill., part number CO87-M6-S17. A spring plunger 274 is slidably received within passage 270 and circumferentially surrounds spring 272. Passage 270 does not extend all the way through coupler sleeve 234 but terminates in a smaller diameter opening 273. Referring also to FIG. 2D, an interlock ring 280 is press fit within opening 273 such that a surface 282 of the ring is flush with a surface 284 of coupler sleeve 234. A screw 286 is received within through bore 288 of ring 280 and rests on a shelf 290 of through bore 288. Spring plunger 274 includes an internally threaded shaft 292 in which screw 286 is threaded. When force is applied to spring plunger 274 along arrow 294, the spring plunger moves against the force applied by spring 272, compressing the spring, and screw 286 slides within through bore 288.

Figure 3:
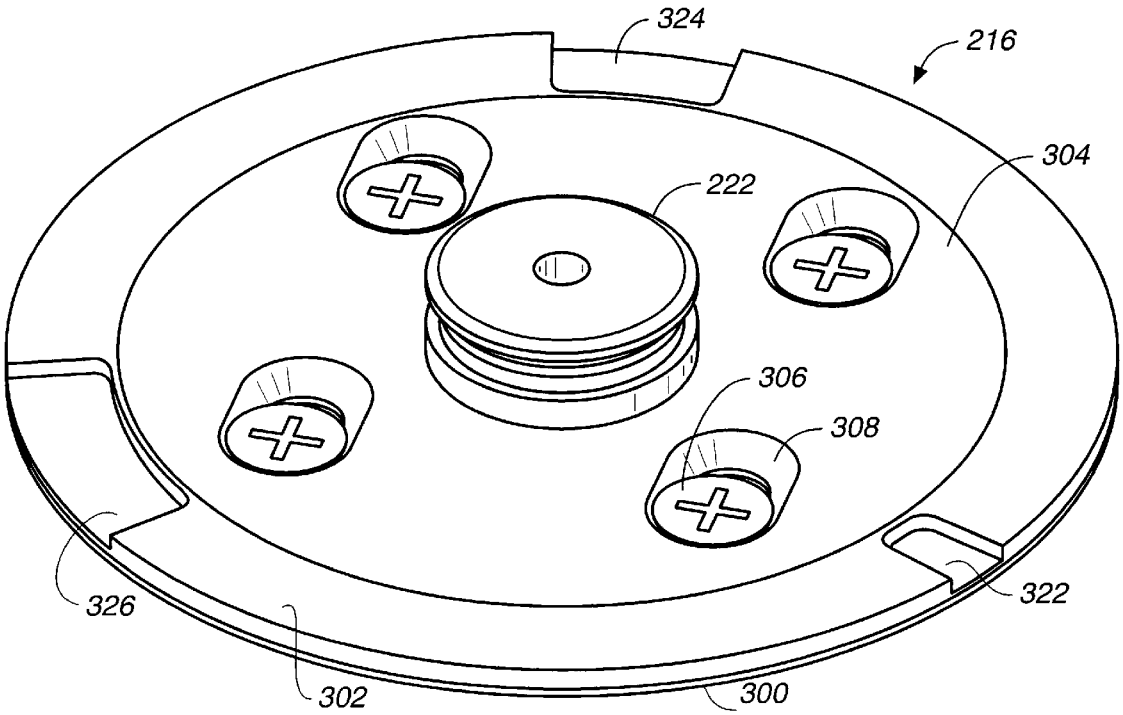
FIG. 3 is a perspective view of a lower attachment plate of the binding of FIG. 1.
Figure 3A:
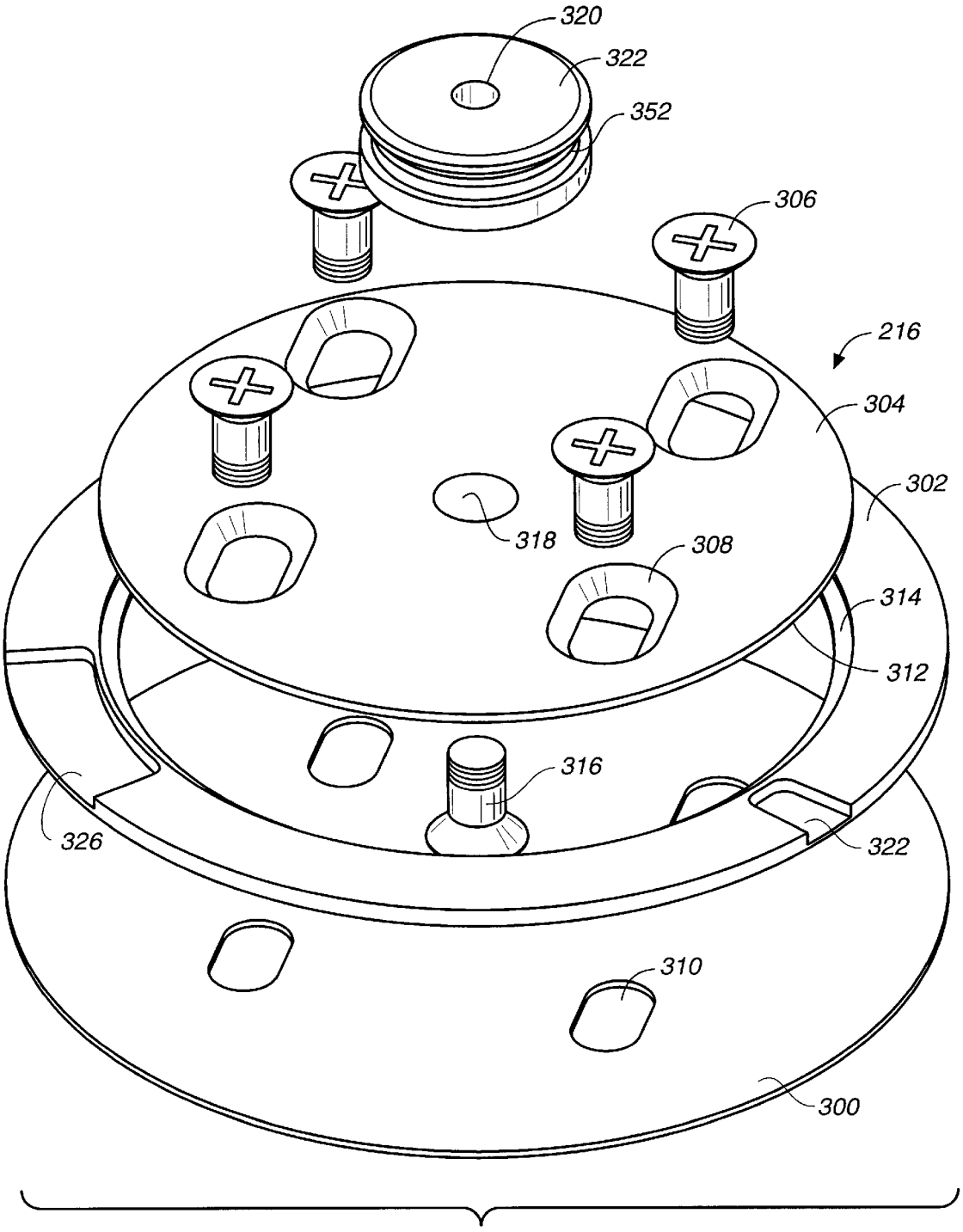
FIG. 3A is an exploded view of the lower attachment plate.

Referring to FIGS. 3 and 3A, lower plate 216 includes a spacer or board guard 300, an alignment ring 302, and a mounting plate 304. To attach lower plate 216 to board 218, screws 306 are provided which pass through screw slots 308, 310 in mounting plate 304 and board guard 300, respectively, and screw into binding mount holes (not shown) in board 218. An edge 312 of mounting plate 304 abuts against a shelf 314 of alignment ring 302 trapping the alignment ring between mounting plate 304 and board guard 300 when lower plate 216 is attached to board 218.

Figure 3B:
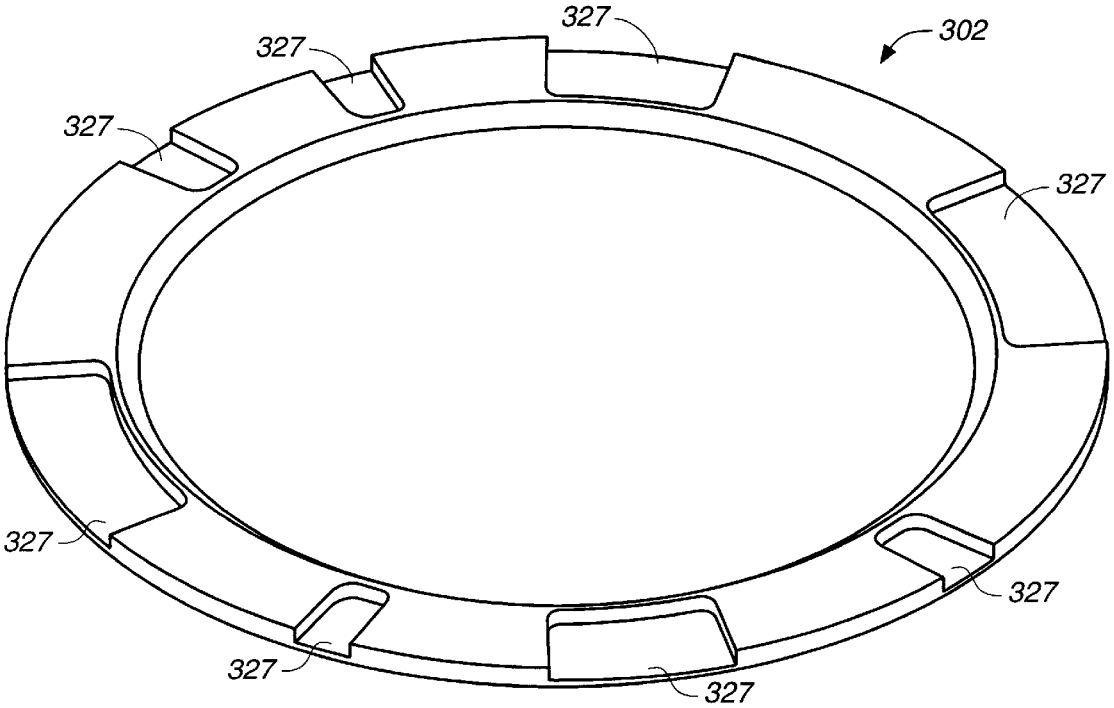
FIG. 3B is a perspective view of an alternative embodiment of an alignment ring of the lower attachment plate.

With board guard 300, alignment ring 302, and mounting plate 304 assembled as shown in FIG. 3, a bolt 316 attached to board guard 300 extends through a hole 318 in mounting plate 304. Coupling mount 222 defines a threaded through bore 320 and is attached to lower plate 216 by threading it onto bolt 316. Alignment ring 302 includes three cut-outs 322, 324, 326, described further below. Alternatively, alignment ring 302 includes a plurality of cut-outs 327 as shown in FIG. 3B. Board guard 300 may be omitted from lower plate 216. Alternatively, one or more board guards may be used as spacers to adjust the tightness between the board and boot.

Turning now to the locking action of coupler 220. Referring again to FIG. 2C, with spring plunger 274 located in coupler sleeve 234, a wall 340 of spring plunger 274 acts to bias ball bearings 242 radially outward within apertures 244 and against inner wall 240 of collar 236. Inner wall 240 includes outermost surfaces 342, ramped surfaces 344, and innermost surfaces 346. With ball bearings 242 biased outward, collar 236 is forced to rotate such that it is the ramped surfaces 344 of inner wall 240 and not innermost surfaces 346 which abut ball bearings 242.

Referring again to FIG. 2A, an extension spring 350, for example, formed of spring stainless steel and having an outer diameter of 0.240", a length of 1.000", and a wire diameter of 0.040", applies a force to handle 262 of collar 236 acting against the outward force applied by spring plunger 274. The force applied by extension spring 350 to handle 262 acts to rotate collar 236 in the opposite direction as that of spring plunger 274 toward a position in which innermost surfaces 246 of inner wall 240 abut ball bearings 242. A pin 351 attached to inner mount 232 slides within a slot 353 of arm 262 to limit the travel of collar 236.

When attaching boot 214 to board 218, coupling mount 222 is used to apply force along arrow 294 to spring plunger 274 acting against spring 272. This axial load pushes spring plunger 274 further into coupler 234 and past ball bearings 242, and locates coupling mount 222 in passage 270. With spring 350 acting to rotate collar 236 such that innermost surfaces 246 abut ball bearings 242 biasing ball bearings 242 inward, the ball bearings 242 are forced into a circumferential channel 352 (FIG. 3*a*) in cylindrical coupling mount 222. The action of spring 350 effectively locks coupling mount 222 in passage 270 by biasing ball bearings 242 inward into channel 352. With upper plate 212 thus locked to lower plate 216, the upper plate is still free to rotate relative to the lower plate because of sliding contact between ball bearings 242 and channel 352.

To further insure that upper plate 212 is locked to lower plate 216, i.e., to prevent rotation of collar 236 allowing ball bearings 242 to move outward, locking pawl 380 is provided with a pin 382 which is received within a hole 384 in collar 236 when collar 236 is positioned such that its innermost surfaces 346 abut ball bearings 242.

Figure 4:
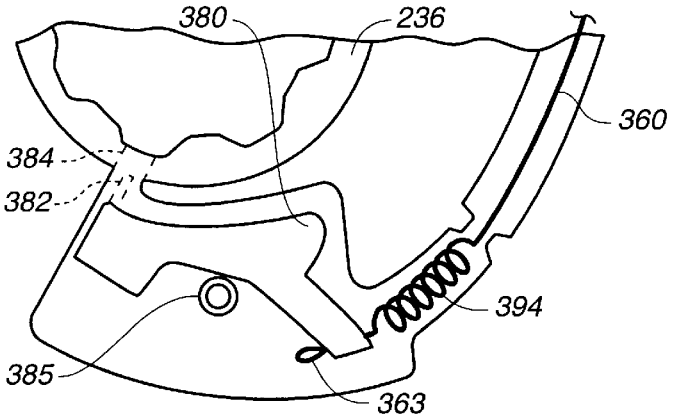
FIG. 4 is an illustration of the locking pawl of the upper attachment plate.

Referring also to FIG. 4, locking pawl 380 is mounted within a cut-out 385 in outer housing 230 by a pivot post 386. Pivot post 386 extends through a hole 388 in a cover 390 and is press fit into a stud 392 in outer housing 230. An extension spring 394, for example, formed of spring stainless steel and having an outer diameter of 0.860", a length of 1.125", and a wire diameter of 0.029", acts to bias pawl 380 to rotate about post 386 such that pin 382 is located within collar hole 384 when the pin and hole are aligned.

To remove boot 214 from board 218, the user pulls on strap 224 which is attached to a cable 360 (FIG. 2A). Cable 360 is located within channels 370, 372 in outer housing 230. Cable 360 is connected at one end 361 to arm 262 by screw 362. Cable 360 is connected at its opposite end 363 to pawl 380. Pulling on cable 360 rotates collar 236 such that outermost surfaces 324 of collar 236 are aligned with ball bearings 242, and rotates pawl 380 such that pin 382 exits collar hole 384, thus unlocking coupling mount 222 from coupler 220. Thus, decoupling is accomplished by a rotational motion on collar 236. By pulling up on boot 214, ball bearings 242 are forced out of channel 352 in coupling mount 222 and boot 214 can be removed from board 218.

Referring again to FIG. 1, outer housing 230 includes a lock 400 for rotationally locking boot 214 relative to board 218. The user actuates lock 400 with a handle 402. Referring to FIGS. 2A and 2B, lock 400 includes a plunger 404 received in a side arm 406 of outer housing 230. Rotating handle 402 causes plunger 404 to slide within side arm 406 by the action of an extension spring 405, for example, formed of spring stainless steel and having an outer diameter of 0.240", a length of 1.000", and a wire diameter of 0.040". In its extended position, plunger 404 extends beyond the bottom surface 408 of outer housing 230.

Referring again to FIG. 3, plunger 404 may be extended when it is aligned with one of cut-outs 322, 324, 326. This acts to limit the amount boot 214 can be rotated relative to board 218 by the length of the cut-outs. With plunger 414 located in cut-out 322, the boot is rotationally fixed. Alignment ring 302 can be adjusted to the desired degree of foot angle. The cut-outs permit the choice of boot angle, for example, so that either the left or right boot can be the lead down the hill. Alignment ring 302 can also be interchanged with alignment rings having different width of cut-outs to permit further customization.

Referring now to FIGS. 5–10 of the drawings, there is shown an exemplary embodiment of a rotatable quick coupling and release binding 15 of the present invention. The binding 15 is employed between the boot 20 and the snowboard 10. The binding 15 permits the boot 20 and thus the foot of the rider to be adjustable rotated from one stance position to 20°, 30°, 40° angular positions relative thereto as determined by slotted positions selected by the rider on the alignment ring 104 of the binding 15. However, rotations is not limited to these pre-slotted alignment holes 106 but can rotate 360 by simply attaching the release ring 95 of the binding 16 to a release ring hook 96 mounted on the side of the boot 20 allowing unlimited rotation while snow boarding.

Figure 5:
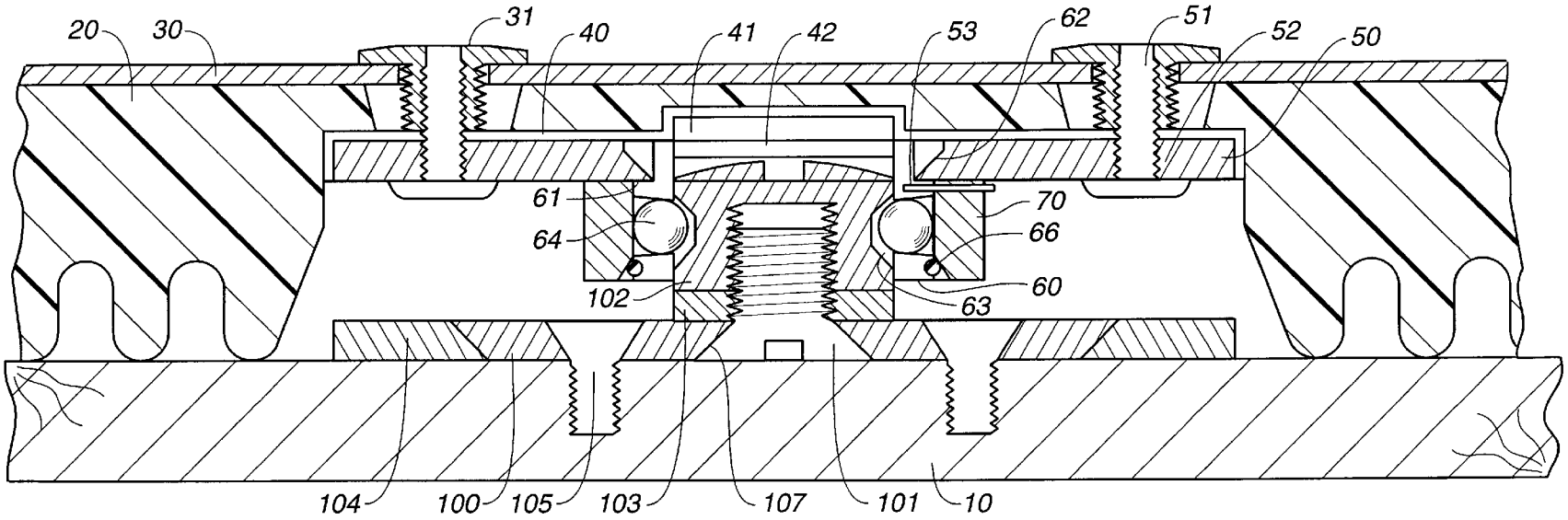
FIG. 5 is a cross-sectional view of an alternative embodiment of the boot, binding, and snowboard in a coupled position.

Referring to FIG. 5, there is illustrated the exemplary embodiment of the binding 15 which basically includes: (1) upper attachment means formed by an inner boot plate 30, snow plunger spring plate 40 and boot mounting plate 50 mounted to the bottom of the snowboot 20; (2) lower attachment means formed by a board mounting plate 100 mounted to the top of the snowboard 10; (3) bearing means rotatably coupling the upper attachment means with the lower attachment means to permit rotation of the snowboot 20 relative to the snowboard 10, the bearing means being formed by a female coupler sleeve 60 secured to the boot mounting plate 60 and an outer bearing collar 70 surrounding and secured to the female coupler sleeve 60; (4) releasing means having a binding release cable 80 attached to the outer bearing collar 70 of the bearing means which when pulled moves the outer bearing collar 70 to an unlocked position and when released allows the outer bearing collar 70 to return to a locked position; and (5) latching means formed by a latch mechanism 90 mounted to the boot mounting plate 50 of the lower attachment means and having a latch release cable 92 which when pulled unlatches from the board mounting plate 100 and permits changing of the angular stance position of the rider to a free rotation condition. The board mounting plate 100 is rotatably coupled to the boot mounting plate 50 via ball bearings 64 of the bearing means which are rollably supported between the female coupler sleeve 60 of the bearing means and a central male coupler 102 of the board mounting plate 100 which also forms part of the bearing means.

As seen in FIGS. 5, 6, 11, 16 and 17, the upper securement means of the binding 15 also includes mounting screws 51 which secure the boot mounting plate 50 and the snow plunger plate 40 to the bottom of the snowboot 20. The snow plunger plate 40 has a raised circular area attaching a tapered spring 41 and plunger 42.

Figure 18:
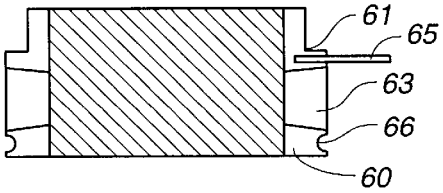
FIG. 18 is a cross-sectional view of the female coupler sleeve of the binding of FIG. 5.
Figure 19:
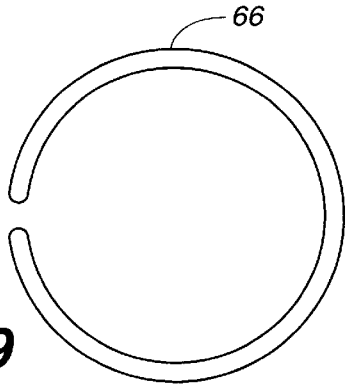
FIG. 19 is a top plan view of the snap ring of the binding of FIG. 5.

As seen in FIGS. 5 and 18, the female coupler sleeve 60 of the bearing means has a shoulder 61 and is secured to the boot mounting plate 50 by swedging 62 to the recessed center hole 53 in the plate 50. The female coupler sleeve 60 has tapered ball bearing holes 63 defined therein allowing the ball bearings 64 to travel inwardly without falling out.

As seen in FIGS. 5, 6 and 18–22, the bearing means also includes a snap ring 66 and stop pin 65. The outer bearing collar 70 is held to the female coupler sleeve 60 by the snap ring 66 and is rotatable relative to the female coupler sleeve 60 through a preset arc of rotation established by the stop pin 65 fixed to and extending from the female coupler sleeve 60 and fitting into a stop pin notch 71 formed in the top annular edge of the outer bearing collar 70. The outer bearing collar 70 has interior circumferentially spaced grooves 72 which allow the ball bearings 64 to roll into an open position when the binding release cable 80 of the releasing means is pulled. Upon release of the binding release cable 80, the collar spring 73 of the bearing means returns the outer bearing collar 70 back to the locked position.

The releasing means also includes a screw 82 attaching the binding release cable 80 to the outer bearing collar 70. The screw 82 is held by threads 74 formed in the outer bearing collar 70 diagonally opposite from the spring hole 75 defined therein. The binding release collar 80 runs through an outer sleeve 83 of the releasing means which is secured to the boot mounting plate 50 by a clamp-down bracket 82 attached by one of the mounting screws 51 to the plate 50. The binding release cable 80 and outer sleeve 83 run through the outer edge of the boot mounting plate 50 (see FIG. 6) and then are routed through the boot sleeve 85 mounted along the exterior side of the snowboot 20. A ring 86 of the releasing means attached to the end of the binding release cable 80 extending above the boot sleeve 85. The collar spring 73 is secured to the boot mounting plate 50 by tow of the mounting screws 51 (see FIG. 6) and has an end which projects into the spring hole 75 defined in the periphery of the outer bearing collar 70.

Referring to FIGS. 5, 7, 8, 15, 23 and 24, the lower securement means also includes mounting screws 104 which mount the board mounting plate 100 of the lower securement means to the top surface of the snowboard 10, and a male mounting bolt 101 which extends upwardly through a hole 107 in the board mounting plate 100. Spacers 103 are used under the central threaded male coupler 102 of the board mounting plate 100 to allow adjustment of the tightness between the snowboard 10 and the snowboot 20. The outer adjustment ring 104 of the lower securement means is held down by the board mounting plate 100 allowing the alignment ring 104 to be rotated and affixed to the desired alignment slot/hole 106.

Figure 6:
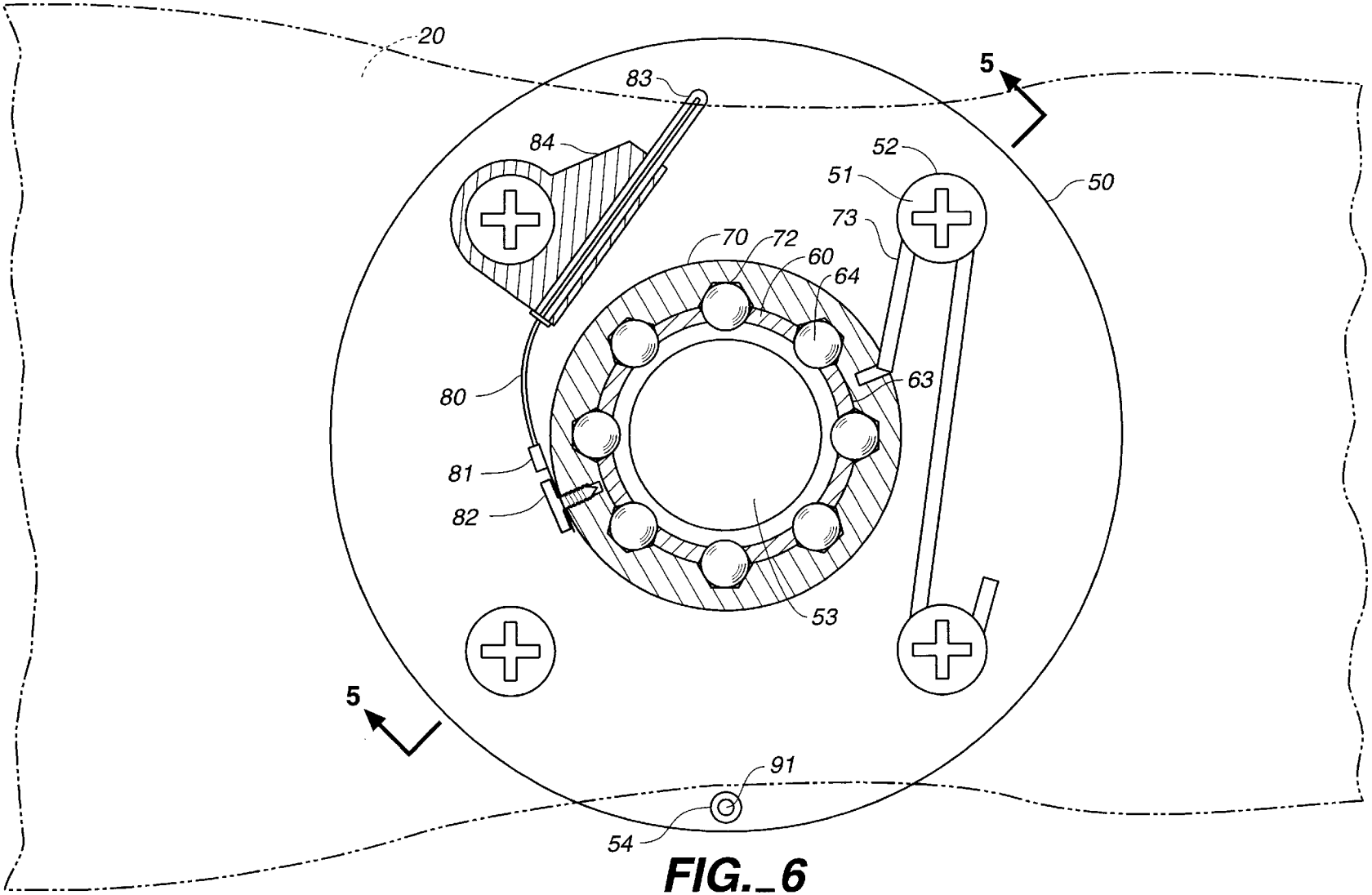
FIG. 6 is a bottom plan view of the bottom of the boot of FIG. 5 with the binding in a released position.
Figure 7:
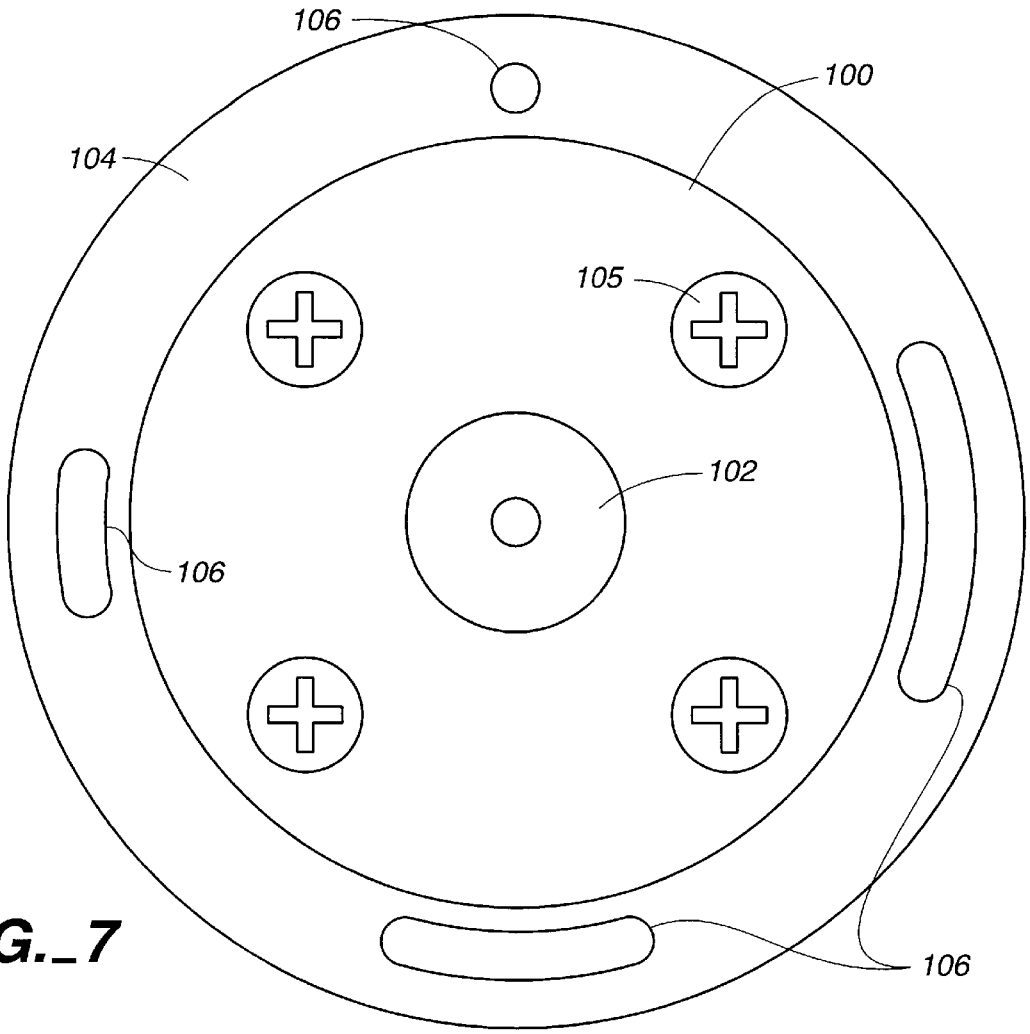
FIG. 7 is a top plan view of a male connector, board mounting plate and alignment ring of the binding of FIG. 5.
Figure 8:
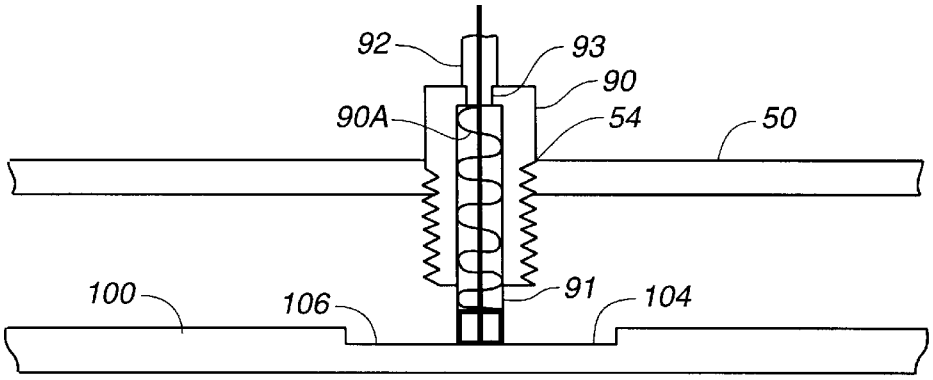
FIG. 8 is a cross-sectional view of a latch mechanism, boot mounting plate and alignment ring of the binding of FIG. 5.
Figure 10:
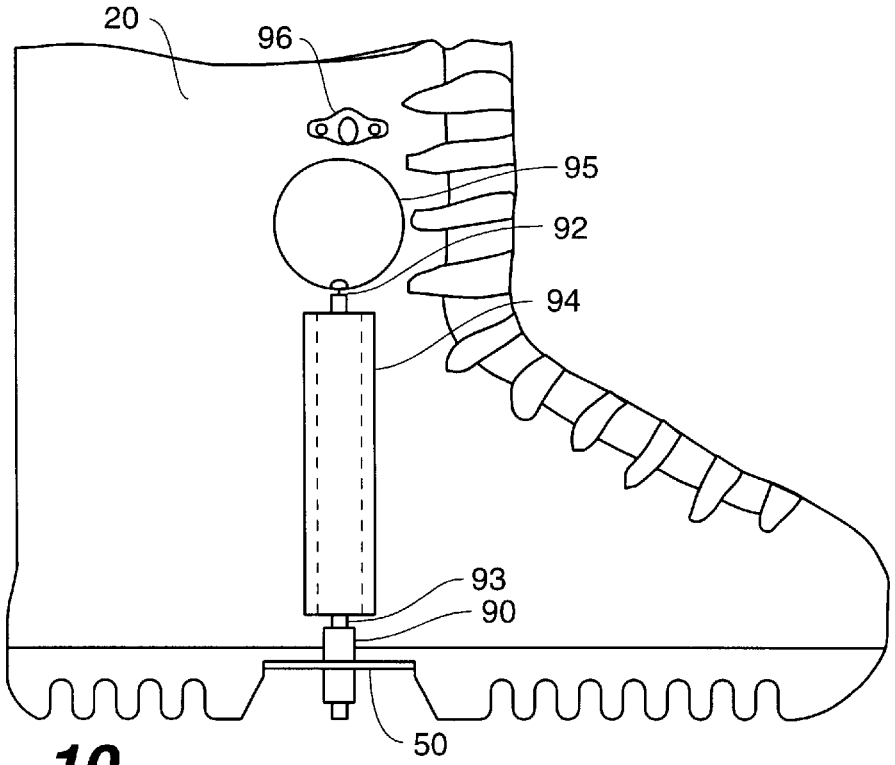
FIG. 10 is a side elevational view of the boot with an alignment release mechanism of the binding of FIG. 5.
Figure 11:
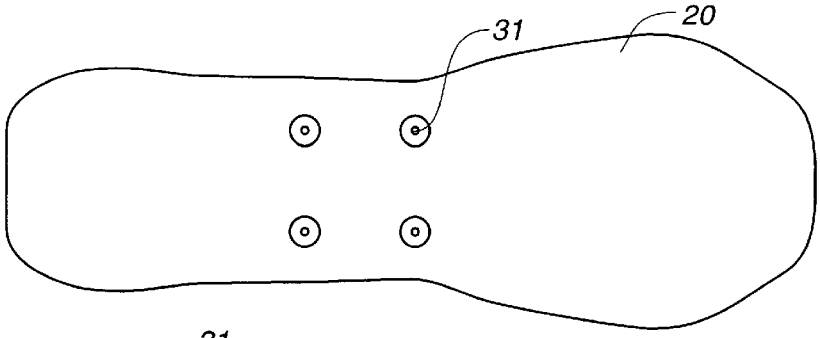
FIG. 11 is a bottom plan view of the boot with inner plate stand-offs of the binding of FIG. 5.
Figure 12:
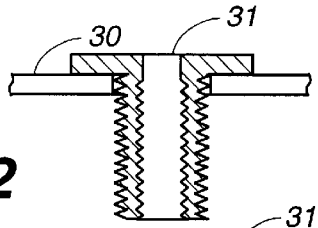
FIG. 12 is a cross-sectional view of the male portion of the inner plate stand-off of FIG. 11.
Figure 13:
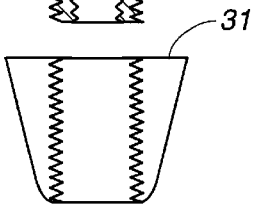
FIG. 13 is a cross-sectional view of the female portion of the inner plate stand-off of FIG. 11.
Figure 14:
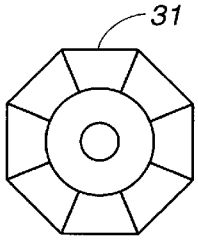
FIG. 14 is a top plan view of the inner plate stand-off of FIG. 11.
Figure 15:
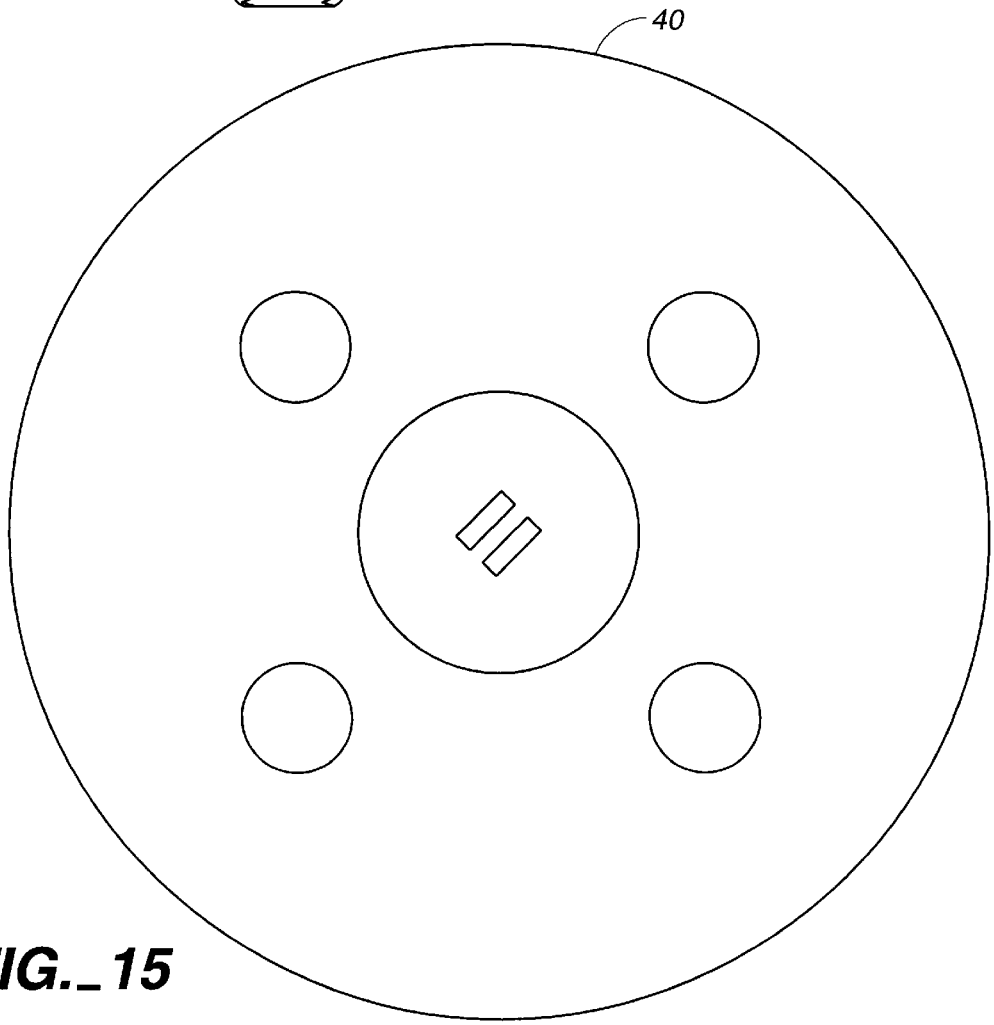
FIG. 15 is a top plan view of the boot mounting plate of the binding of FIG. 5.
Figure 16:
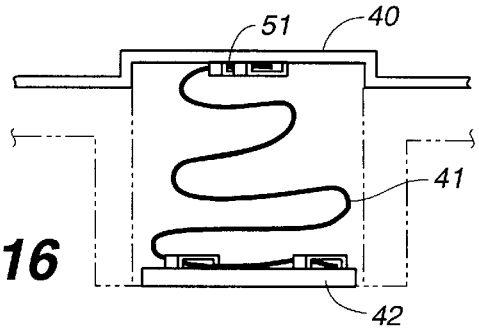
FIG. 16 is a cross-sectional view of the snow plunger of the binding of FIG. 5.
Figure 17:
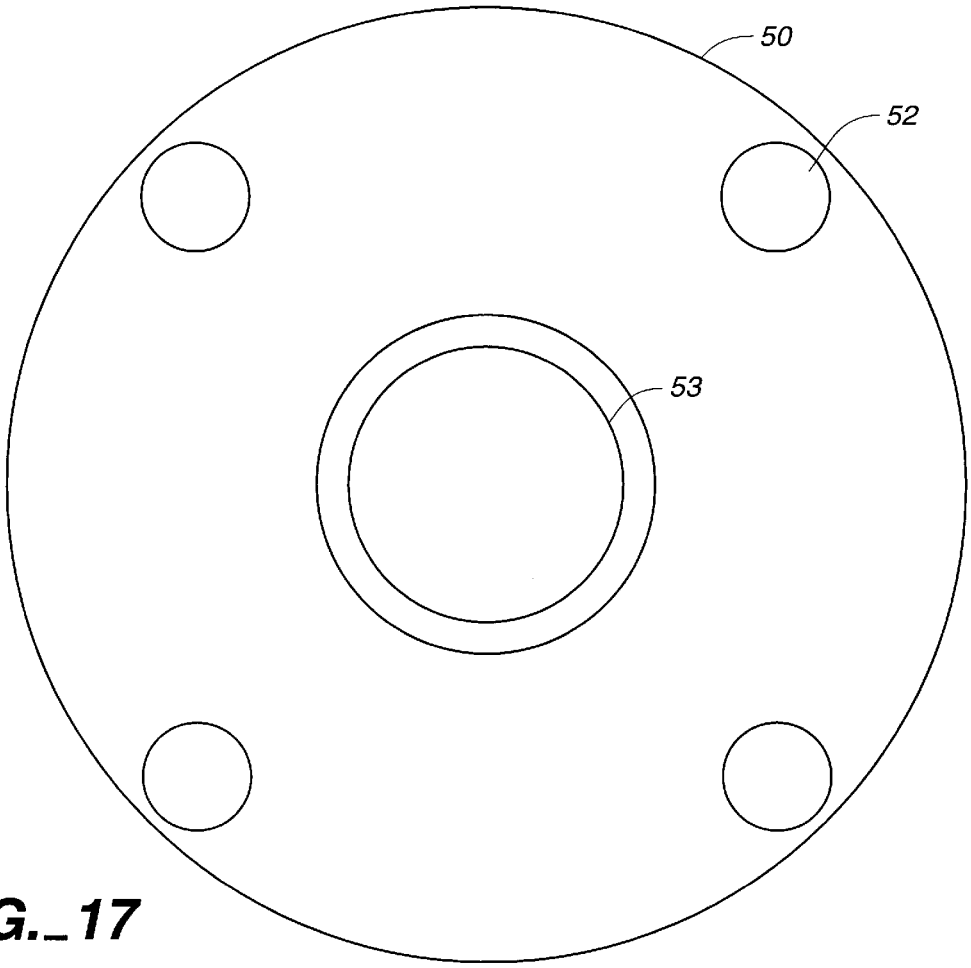
FIG. 17 is a top plan view of the snowboard mounting plate of the binding of FIG. 5.

Referring to FIGS. 6, 8 and 10, the latch mechanism 90 of the latching means is mounted to the threaded latch hole 54 in the periphery of the boot mounting plate 50 and extends therefrom toward the board mounting plate 100. A vertically movable plunger 90A of the latch mechanism 90 is aligned with the rotatably adjustable alignment ring 104 and therefore the selected alignment slot/hole 106. The latching means also has a latch release cable 92 routed through a sleeve 93 and a boot sleeve 94 mounted along an exterior side of the snowboot 20. A latch ring 95 is disposed above the boot sleeve 94 and affixed to the end of the latch release cable 92 for the rider to use for pulling on to remove the plunger 90A from the selected slot/hole 106 in the alignment ring 104 so as to change the angular stance position to a free rotation 360° condition, and to stay in this free rotation condition by placing the ring 95 over a release ring hook 96 mounted to the side of the snowboot 20 above the boot sleeve 94.

Plunger 90A can be set in the up (unlatched) position. When plunger 90A in the down (latched) position it is under spring tension. The rider can thus use the step-on coupler-decoupler action in conjunction with the position of latch mechanism 90 in several ways.

The rider may step on the board with the latch in the down position to couple the boot to the board and engage the latch with a selected slot 106. Adjustment to a different boot position can be accomplished by moving the latch to the up position, without disengaging the coupler, rotating the boot to a new position, and moving the latch to the down position to engage on a different slot 106.

The rider may also adjust position of the boot by using only the step-on action of the coupler. With the latch in the down position, the rider may step-on the board to couple the boot to the board and engage the latch with a selected slot 106. Adjustment to a different position can be accomplished by disengaging the coupler and stepping on the board again with the boot in a different rotational position to re-couple to the board and engage the latch with a different slot 106.

The rider may also step on the board with the latch in the down position without aligning the plunger 90A with a slot 106. The boot will then be coupled to the board, but there will be some rotational freedom of the boot. The rider may then rotate the boot, while coupled to the board, until the plunger 90A engages on a slot 106. Since the plunger 90A is under spring tension, it will automatically latch into the first slot 106 encountered during the rotational movement of the boot.

Figure 9:
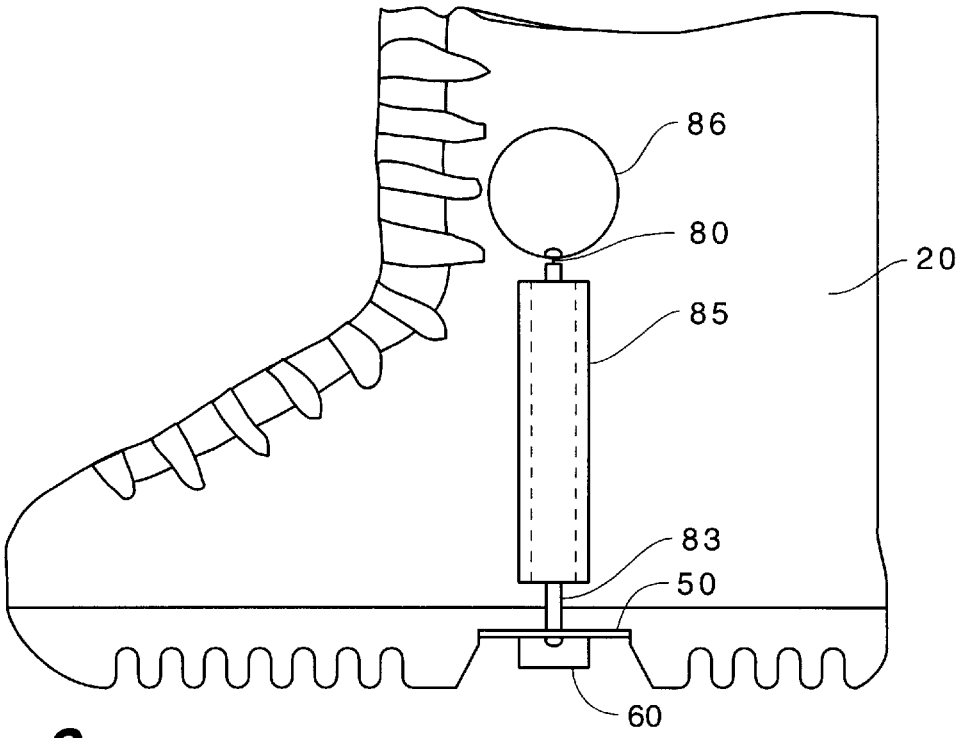
FIG. 9 is a side elevational view of the boot with a coupling release mechanism of the binding of FIG. 5.

FIGS. 9 and 10 illustrate the female coupler sleeve 50 being located near the central part of the boot and the user's foot. For 360° rotation of the female coupler sleeve 50, the male coupler 102 is positioned near the longitudinal centerline of the board. With this arrangement, any overhangs of the heels and toes of a user's boot over the edges of a board are kept equal. The female coupler engages the male coupler such that a lower surface of the user's boot directly contacts a top surface of the snowboard. This allows forces to be directed from the ball and heel of a user's boot and foot to be transmitted directly to the surface of the board.

Figure 25:
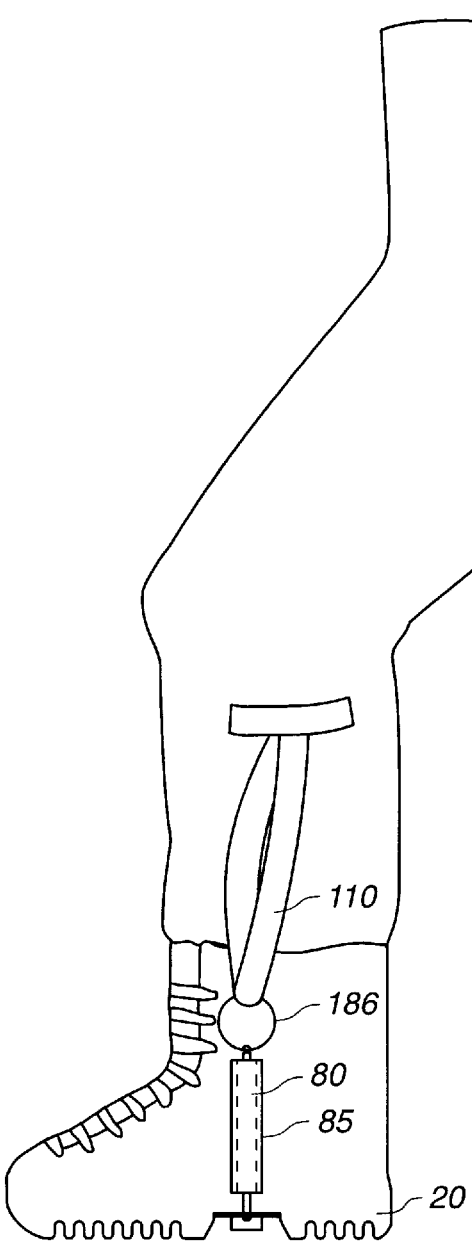
FIG. 25 is a side elevational view of a pant mounted release cable arrangement of the binding of FIG. 5.
Figure 26:
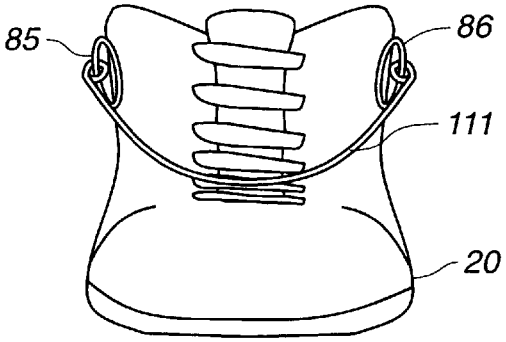
FIG. 26 is a front elevational view of a modified from of an accessory release and alignment pull cable of the pant mounted release cable arrangement of FIG. 25.
Figure 27:
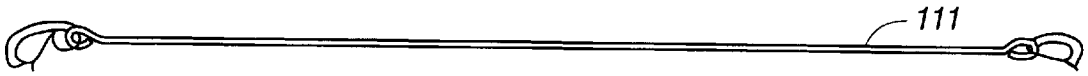
FIG. 27 is a plan view of the accessory release and alignment pull cable of FIG. 26.

FIG. 25 illustrates an arrangement 110 wherein extension of the binding release cable 80 is mounted to a pant leg so as to be more accessible to the rider in case of an incident where the rider becomes buried in the snow and is unable to reach to the boot but is able to reach to the lower leg. The cable so may be extended, for example, to a higher location on the upper leg or hips, if desired, and attached elsewhere on a garment of the rider. FIGS. 26 and 27 show an alternative or modified form of the arrangement of FIG. 25 wherein an accessory release and alignment pull cable 111 is provided across the front of the boot.

While the above-described embodiments show a centrally mounted step-on coupler on the boot used with a single coupling mount on the board, it will be resized that multiple couplers may be used. For example, two step-on couplers may be used, one at the toe and one at the heel of the boot. The coupling mount may comprise a ring, accommodating the two corresponding mounts to mate with the couplers on the toe and heel. The ring may be slidably engaged with a central mounting plate, thus providing rotational movement of the boot while coupled to the board.

What is claimed is:

1. A binding, comprising:

a boot comprising an upper attachment, a lower attachment connectable to a board, a coupler attached to one of said upper and lower attachments, and a coupling mount attached to the other of said upper and lower attachments, the coupling mount and the coupler being configured to automatically engage with each other to lock the upper attachment to the lower attachment when a user wearing the boot steps onto the lower attachment and to permit rotation of the upper attachment relative to the lower attachment when the upper attachment is locked to the lower attachment without release of said upper attachment from said lower attachment.

2. The binding of claim 1 further comprising a release actuator which is actuated to disengage the coupler and the coupling mount.

3. The binding of claim 2 wherein said actuator is attached by a cable to a garment.

4. The binding of claim 1 further comprising a lock for locking the boot in a selected rotary position relative to the board.

5. The binding of claim 1 wherein said coupler is attached to the upper attachment.

6. The binding of claim 1 wherein said upper attachment comprises:

a mount for attachment to a sole of said boot.

7. The binding of claim 6 further comprising an outer housing attached to said mount.

8. The binding of claim 6 wherein said coupler is attached to said mount.

9. The binding of claim 1 wherein said coupler comprises a collar and a sleeve positioned within the collar, said collar being rotatable relative to said sleeve.

10. The binding of claim 1 comprising two couplers and two corresponding coupling mounts, said couplers and coupling mounts displaced for toe and heel engagement on said boot.

11. The binding of claim 9 further comprising a release actuator attached to said collar, the release actuator being actuated to rotate said collar to disengage said coupler and said coupling mount.

12. The binding of claim 11 further comprising a spring biasing said collar against rotating.

13. The binding of claim 9 further comprising a locking mechanism for locking the position of said collar.

14. The binding of claim 9 wherein said coupler further includes ball bearings, said sleeve including apertures in which the ball bearings are located.

15. The binding of claim 14 wherein said collar includes an inner wall defining a plurality of inner surfaces for contacting said ball bearings.

16. The binding of claim 15 wherein said sleeve defines a passage for receiving said coupling mount, said ball bearings location within said sleeve apertures being affected by the presence of said coupling mount within said through hole.

17. The binding of claim 16 wherein said coupler further comprises a spring and spring plunger located within said passage.

18. The binding of claim 13 wherein said coupling mount includes a circumferential channel in which said ball bearings are partly enclosed, said coupling mount being rotatable relative to said sleeve with said ball bearings sliding along said circumferential channel during rotation of said coupling mount.

19. The binding of claim 1 wherein said coupling mount is attached to said lower attachment.

20. The binding of claim 19 wherein said coupling mount is cylindrical and accommodates a circumferential channel.

21. The binding of claim 1 wherein said lower attachment includes an alignment ring.

22. The binding of claim 20 wherein said alignment ring includes a cut-out.

23. The binding of claim 1 further comprising a lock selectively positionable for locking said boot in a selected rotary position relative to said board.

24. The binding of claim 22 wherein said cut-out comprises a slot.

25. The binding of claim 24 wherein said lock is selectively positionable in said cut-out for permitting limited rotation of said boot relative to said board.

26. The binding of claim 22 wherein said alignment ring includes a plurality of cut-outs.

27. The binding of claim 21, 22 or 24 wherein said lower attachment further includes a mounting plate, said alignment ring being locked in a selected rotated position relative to said mounting plate.

28. The binding of claim 21 wherein said lower attachment further includes a spacer.

29. The binding of claim 1 wherein a lower surface of said boot contacts a top surface of said board to permit forces to be directly applied from said boot to the top surface of said board.

30. The binding of claim 1 wherein said coupler is located substantially at a central part of said boot and said coupler mount is located substantially at a longitudinal centerline of said board.

31. A coupling device, comprising:

an upper attachment connectable to a first member, a lower attachment connectable to a second member, a coupler attached to one of said upper and lower attachments, and a coupling mount attached to the other of said upper and lower attachments, wherein the coupling mount and the coupler are configured to engage and lock with each other with a linear motion to lock the upper attachment to the lower attachment and to permit rotation of said upper attachment relative to said lower attachment when said upper attachment is locked to said lower attachment without release of said upper attachment from said lower attachment; and wherein said coupler and coupling mount are unlocked by a rotational motion on said coupler.

* * * * *

UNITED STATES PATENT AND TRADEMARK OFFICE

CERTIFICATE OF CORRECTION

PATENT NO. : 5,913,530

DATED : June 22, 1999

INVENTOR(S) : Berger et al.

It is certified that error appears in the above-identified patent and that said Letters Patent is hereby corrected as shown below:

Title page, item

[22] Filed: change "Jun. 16, 1997" to --Jun. 24, 1997--.

Signed and Sealed this

Fourteenth Day of March, 2000

*Attest:*

Q. TODD DICKINSON

*Attesting Officer*

*Commissioner of Patents and Trademarks*